US005921126A

United States Patent [19]

Miller

[11] Patent Number: 5,921,126

[45] Date of Patent: Jul. 13, 1999

[54] METALWORKING DIES WITH SOFT METAL LUBRICANT PLATINGS

[75] Inventor: Mark Lloyd Miller, Schenectady, N.Y.

[73] Assignee: General Electric Company, Schenectady, N.Y.

[21] Appl. No.: 08/655,543

[22] Filed: May 31, 1996

[51] Int. Cl.[6] ..... B21B 45/02; B21B 23/24

[52] U.S. Cl. ..... 72/42; 72/47; 508/165; 508/108

[58] Field of Search ..... 72/41, 42, 46, 72/47, 462; 508/165, 108

[56] References Cited

U.S. PATENT DOCUMENTS

| | | | |
|---|---|---|---|
| 3,360,157 | 12/1967 | Bolt et al. | 72/349 |
| 3,655,349 | 4/1972 | Shah et al. | 72/42 |
| 4,040,282 | 8/1977 | Saunders | 72/41 |
| 4,074,922 | 2/1978 | Murdoch | 308/8.2 |
| 4,095,449 | 6/1978 | Roach et al. | 72/467 |
| 4,571,983 | 2/1986 | Sanborn et al. | 72/462 |
| 4,595,473 | 6/1986 | Kalamasz | 204/484 |
| 4,621,026 | 11/1986 | Robinson | 428/422 |
| 4,787,228 | 11/1988 | Weisner et al. | 72/47 |

FOREIGN PATENT DOCUMENTS

| | | | |
|---|---|---|---|
| 358020314-A | 2/1983 | Japan | 72/42 |
| 361199525-A | 9/1986 | Japan | 72/42 |

*Primary Examiner*—Joseph J. Hail, III
*Assistant Examiner*—Rodney Butler
*Attorney, Agent, or Firm*—Marvin Snyder; Douglas E. Stoner

[57] ABSTRACT

A metalworking die has a soft metal plating on its contact surfaces. The plating produces a continuous lubricant supply which is only depleted slowly when employed in a hot metalworking operation. In forming a near-net-shape part using this die, the metalworking piece is coated with a glass lubricant. A temporary lubricant of graphite is also sprayed on the coated die.

15 Claims, 1 Drawing Sheet

METALWORKING DIES WITH SOFT METAL LUBRICANT PLATINGS

This invention relates to metalworking dies. More particularly, this invention is directed to metalworking dies with soft metal platings and to a method of hot working a metal workpiece.

Industries such as aircraft engine and turbine manufacturing employ hot metalworking operations such as extrusion and forging to produce high quality, near-net-shape parts with good quality surface finishes. Achieving the necessary degree of consistent surface and dimensional quality requires metalworking lubrication capable of providing protection for the highly finished and accurate dies. The processing involves repeated contact between these dies and the hot workpiece metals under very high pressures. Under these conditions the workpiece tends to wear the dies by such mechanisms as erosion, galling and abrasion. The workpiece metals employed, such as titanium alloys, are often especially prone to aggressive attack on the dies. Worn dies then produce parts of unacceptable quality.

Current practice in metalworking employs lubricant systems typically comprising a glass applied to the workpiece plus an accessory lubricant such as graphite applied by spraying onto the dies prior to working each piece. It has been found that glasses containing lead oxide are especially effective as lubricants for precision metalworking. However, the lead is undesirable in an industrial process.

It is apparent from the above that there exists a need in the art for an improved metal working die and a method of hotworking a metal workpiece. It is a purpose of this invention to fulfill this and other needs in the art in a manner more apparent to the skilled artisan and given the following disclosure.

SUMMARY OF THE INVENTION

The above-mentioned needs are met by the present invention which relates to metalworking dies with soft metal platings. More particularly, an article of the present invention comprises a metalworking die, and an adherent soft metal plating on the contact surfaces of the die.

In another embodiment of the invention, a method of hotworking a metal workpiece comprises providing a metalworking die, applying an adherent soft metal plating on the contact surfaces of the die, applying a temporary accessory graphite lubricant on the plating, providing a metal workpiece with a glass lubricant film thereon, preheating the workpiece, and hot working the workpiece with the die producing a near-net-shape part with a good quality finish.

BRIEF DESCRIPTION OF THE DRAWINGS

The subject matter, which is regarded as the invention, is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
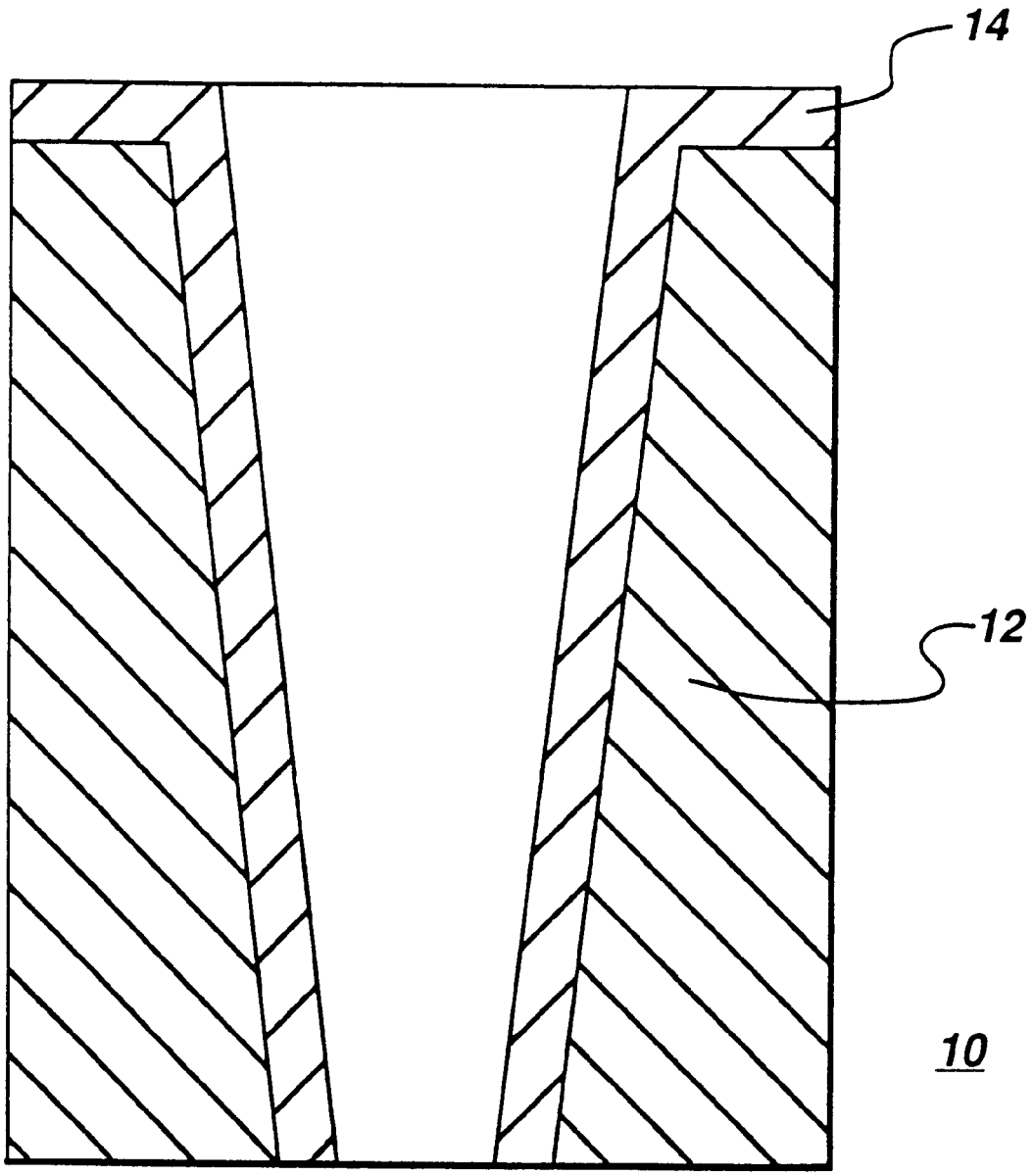
FIG. 1 is a sectional view of a metal working die with an adherent soft metal plating on the contact surfaces of the die in accordance with the present invention.

FIG. 1 shows an article 10 of the present invention which comprises a metal working die 12, and an adherent soft metal plating 14 on the contact surfaces of die 12. The adherent plating or film 14 is a soft metal, such as, tin, bismuth or their alloys. The soft metal plating or film 14 is applied by methods, such as electroplating, electroless plating, evaporative coating, sputtering, or chemical deposition. The thickness of the plating may vary over a wide range, but it is preferred to use a thickness of 2–10 micrometers. The plated die is then employed in the usual manner in the hot working of metal workpieces. The soft metal plating on the contact surfaces of the die provides a continuous lubricant supply which is only depleted slowly as numerous parts are worked. When the improved die with the soft metal plating thereon is used in hot working of metal pieces, temporary accessory lubricants, such as graphite sprays are used on the dies. It is also conventional to employ a glass lubricant coating on the workpiece.

In the present invention, a method of hot working a metal workpiece comprises providing an article 10 in the form of a metal die 12 as shown in FIG. 1 of the drawing. Die 12 has an adherent metal plating 14 on the contact surfaces of the die. The adherent plating or film 14 is a soft metal, such as, tin, bismuth or their alloys. The soft metal plating is applied by methods, such as, electroplating, electroless plating, evaporative coating, sputtering or chemical deposition. While the thickness of the plating may vary over a wide range, it is preferred to use a thickness of 2–10 micrometers.

A metal workpiece is provided for the hot working operation. A glass coating is applied to the workpiece to produce a glass lubricant film thereon. The workpiece with the glass lubricant thereon is preheated in a pre-heat furnace to provide a better temperature for working the metal and to provide the glass in a molten state. The plated die is subjected to a temporary accessory lubricant, such as, a graphite spray.

The workpiece is then hot worked with the die having the adherent soft metal plating. The plated soft metal lubricant on the die provides a continuous lubricant supply which is only depleted slowly. A near-net-shape part is produced with a good quality finish.

The foregoing has described an improved metal working die and a method of hotworking a metal workpiece. It will be apparent to those skilled in the art that various modifications thereto can be made without departing from the spirit and scope of the invention as defined in the appended claims.

What is claimed is:

1. A method of hotworking a metal workpiece comprising the steps of:

providing a die having contact surfaces, providing a soft metal selected from the class consisting of tin, bismuth and their alloys, adhering the soft metal as a plating on the contact surfaces of the die, providing a metal workpiece, preheating the workpiece, and hot working the workpiece with the die producing a near-net-shape part with a good quality finish.

2. A method of hotworking a metal workpiece as in claim 1, wherein the step of adhering the soft metal as a plating further includes providing a plating thickness in the range of 2 to 10 micrometers.

3. A method of hot working a metal workpiece as in claim 1, which further includes the step of spraying graphite on the plated die as a temporary accessory lubricant.

4. A method of hotworking a metal workpiece as in claim 1, wherein the step of preheating the workpiece further includes providing a molten glass lubricant on the surface of the workpiece.

5. A method of working a metal workpiece comprising:

passing said metal workpiece through a die to shape said workpiece thereby; and providing a soft metal lubricant between said die and said workpiece, and adhered to said die only.

6. A method according to claim 5 further comprising sequentially passing a plurality of said metal workpieces through said die, and correspondingly depleting said lubricant from said die.

7. A method according to claim 6 wherein said lubricant is selected from the group consisting of tin, bismuth, and alloys thereof.

8. A method according to claim 7 wherein said lubricant has a thickness of about 2 to 10 microns.

9. A method according to claim 8 further comprising:

lubricating said die with an accessory lubricant; and lubricating said workpieces with a different accessory lubricant.

10. A method according to claim 8 further comprising:

lubricating said die with an accessory lubricant;

preheating said workpieces; and lubricating said workpieces with a molten glass such that said workpieces are hotworked when passing through said die.

11. An article comprising:

a metal working die having contact surfaces, an adherent soft metal plating on the contact surfaces of the metal working die, and the soft metal plating selected from a metal consisting of tin, bismuth or their alloys.

12. An article as in claim 11, wherein the soft metal plating has a thickness in the range of 2 to 10 micrometers.

13. A metal working die comprising die surfaces having a soft metal lubricant adhered thereto.

14. A die according to claim 13 wherein said lubricant is selected from the group consisting of tin, bismuth, and alloys thereof.

15. A die according to claim 14 wherein said lubricant has a thickness of about 2 to 10 microns.

* * * * *